United States Patent [19]

Gay et al.

[11] Patent Number: 4,926,930

[45] Date of Patent: May 22, 1990

[54] PROCESS AND MACHINE FOR THE CONTINUOUS CASTING OF A THIN METAL PRODUCT

[75] Inventors: Pierre Gay, L'Etrat; Robert Vatant, Saint-Chamond, both of France

[73] Assignee: Clecim, Courbevoie Cedex, France

[21] Appl. No.: 274,554

[22] Filed: Nov. 22, 1988

Related U.S. Application Data

[63] Continuation of Ser. No. 31,472, filed as PCT FR86/00222 on Jun. 24, 1986, published as WO87/00099 on Jan. 15, 1987, abandoned.

[30] Foreign Application Priority Data

Jun. 25, 1985 [FR] France ..... 85 09661

[51] Int. Cl.[5] ..... B22D 11/00

[52] U.S. Cl. ..... 164/476; 164/459; 164/418; 164/417

[58] Field of Search ..... 164/418, 435, 436, 441, 164/443, 447, 459, 476, 485, 491, 444, 486, 487, 447; 29/527.7

[56] References Cited

U.S. PATENT DOCUMENTS

| | | | |
|---|---|---|---|
| 2,564,723 | 8/1951 | Rossi | 164/439 |
| 3,931,848 | 1/1976 | Schmid | 164/444 |
| 4,635,702 | 1/1987 | Kolakowski et al. | 164/418 |

FOREIGN PATENT DOCUMENTS

| | | | |
|---|---|---|---|
| 1505630 | 12/1967 | France . | |
| 2153152 | 5/1973 | France . | |
| 2155991 | 5/1973 | France . | |
| 52-71340 | 6/1977 | Japan | 164/441 |

*Primary Examiner*—Richard K. Seidel

*Attorney, Agent, or Firm*—Pollock, Vande Sande & Priddy

[57] ABSTRACT

A process and machine for the continuous casting of thin steel products, in which the inner casting space (13) of the mold (1) is given a substantially spindle-shaped cross-section which forms a central part (17) of large thickness (L), making it possible to introduce a jet of molten metal under normal conditions, and having on its sides (18) a small thickness (1) corresponding to that of the product to be produced (53). In a thickness-reducing stand (2) directly at the exit of the mold (1), the central part (17) of the product is progressively flattened to a thickness (1) equal to that of the sides.

13 Claims, 3 Drawing Sheets

PROCESS AND MACHINE FOR THE CONTINUOUS CASTING OF A THIN METAL PRODUCT

This is a continuation of application Ser. No. 031,472 filed as PCT FR 86/00222 on Jun. 24, 1986, published as WO87/00099 on Jan. 15, 1987, now abandoned.

FIELD OF THE INVENTION

The invention relates to a process and a machine for the continuous casting of thin metal products especially steel products in the form of strips.

BACKGROUND OF THE INVENTION

Various processes for continuous casting of metal products are known in the art, but in comparison with casting of non-ferrous alloys, the continuous casting of steel is particularly difficult. The process used normally involves casting the steel in an open-ended mold with cooled walls limiting an inner tubular space, in which the product forms, the latter consisting of a liquid core surround by a skin consisting of a solidified surface shell. This product is discharged continuously through an orifice located at the exit of the mold, the latter usually having a vertical axis, and the product subsequently passes into a secondary cooling device, in which final solidification of the product takes place and which therefore has means of retaining and means of cooling the solidified faces of the product, the assembly as a whole being placed inside a frame forming a sort of tubular jacket surrounding the product, until solidification is completed.

To ensure continuity of casting, the metal, delivered in the molten state in a casting ladle, is poured into an intermediate vessel which makes it possible to ensure continuity of casting during the replacement of the ladle and which is itself provided with a casting hole, the discharge rate of which is adjusted in the conventional way by means of a spout and via which the metal is poured inside the mold. To prevent oxidation of the metal, a submerged nozzle is generally used, comprising a casting tube which penetrates the mold and which dips into the bath of liquid steel.

This process is now perfected as far as concerns the continuous casting of products of varied dimensions, in particular bars often called "billets" or sheets called "slabs". In this case, the inner tubular space of the mold has a rectangular shape limited by two wide walls and two narrow walls which correspond respectively to the long and short sides of the product. However, for casting under good conditions, and particularly to allow penetration of said nozzle into the mold, the slab must have a minimum width determining the thickness of the slab. To date, the minimal thickness of industrially cast slabs is approximately 150 mm.

The problem of the continuous casting of a thin product, i.e., a product of sufficiently small thickness to pass directly into a rolling mill, has been studied for a long time, even since the very start of research in continuous casting. However, the various processes heretofore proposed are generally based on new techniques, for example, wheel systems or cooled-strip systems, and have not yet been adopted for industrial use.

It has also been proposed to use these machines of the conventional type modified for the casting of thin strips.

For example, U.S. Pat. No. 2,564,723 proposes using a mold, the lower part of which has a flattened rectangular cross-section corresponding to that to be imparted to the product and the upper part of which is flared in the form of a funnel, so as to provide a widened central part making it possible to introduce the casting tube.

Such an arrangement solves the problem of introducing the casting tube, but does not make it possible to cast steel continuously on an industrial scale. In fact, after the filing date of the patent, it was found that, during casting, the mold had to be driven in vertical oscillation movements making it possible to prevent the solidified shell from adhering to the walls of the mold. The arrangement described in U.S. Pat. No. 2,564,723 does not allow such oscillating movements.

To solve this problem of oscillations, French Patent No. 1,505,630 also envisages a mold in the form of a funnel, but in which the wide walls converging downwards are composed of sectors of a cylindrical casing, allowing a circular oscillating movement. Such an arrangement is difficult to put into practice and, like the preceding one, assumes that the product is completely formed at the exit of the mold. Consequently, there is a risk of blockage as a result of a wedge effect, with pulling forces exerted in a particularly sensitive zone of the installation.

SUMMARY OF THE INVENTION

The subject of the present invention is a new process and machine making it possible to produce thin products while at the same time preserving the advantages of conventional machines, i.e., in general terms, forming the solidified shell in a mold with cylindrical walls having a generatrix parallel to the casting axis and maintaining a core of molten metal within the product at the exit of the mold, complete solidification taking place in a secondary cooling device comprising means of cooling and retaining at least the large faces of the product until complete solidification.

To make it possible to introduce the casting tube into the mold, the latter, as in the arrangement described above, has a widened central part narrowing towards the sides to a thickness equal to that of the thin product to be cast. This cross-section is preserved up to the exit of the mold, the latter having cylindrical wide walls with generatrices parallel to the casting axis and to the axis of oscillation.

According to the invention, progressive flattening of the central part of the product is carried out to a thickness equal to that of the edges in a thickness-reducing stand located immediately downstream of the exit orifice of the mold and having two respective guide and straightening surfaces for the two large faces of the product, the reduction profile of which is determined as a function of the casting speed and the cooling conditions, so as to exert a pressure distributed uniformly over the entire surface, at the same time causing and controlling, on each of the big faces, the symmetrical movements of two straightening zones from the edge towards the axis, at a speed the respectively axial and radial components of which are substantially constant and coordinated with the casting speed, in order to realize a straightening of the large faces of the product up to complete solidification.

Preferably, the mold is given an inner profile such that the large faces of the product are connected to the small faces at the edge by means of end parts arranged in planes parallel to the casting line and intersecting the small faces of the product perpendicularly, and in the thickness-reducing stand straightening of the central part is carried out with progressive widening of the plane end parts, the latter being maintained perpendicular to the small faces.

According to another advantageous characteristic, the profile of the surfaces retaining the longitudinal faces of the product is determined as a function of the casting speed and the cooling conditions, so that each straightening zone moves towards the axis at a radial speed substantially equal to the radial speed of widening of the already solidified end part of the product and that the complete solidification of the product and the straightening of the large faces are realized substantially at the same moment at the exit of the thickness-reducing stand.

The invention also comprises a machine for continuous casting of thin products, comprising a mold with a widened central part narrowing towards the two sides to a thickness of the order of that of the strip to be cast, and a secondary cooling device which, according to the invention, comprises a thickness-reducing stand located directly below the mold and equipped with retaining means defining two substantially continuous guide surfaces for the large faces of the product and delimiting an inner passage space for the product, the said thickness-reducing stand having on its sides a constant thickness equal to that of the sides of the mold and in its central part a thickness decreasing progressively in the casting direction between an inlet orifice of a cross-section identical to that of the exit orifice of the mold and an exit orifice of rectangular cross-section corresponding to that of the thin product of be cast.

Preferably, in the thickness-reducing stand, the strip-shaped product is left free to widen towards the sides as a function of the flattening of the central part, in such a way that the perimeter cross-section relative to the axis remains preserved.

In an especially advantageous embodiment, the two wide walls of the mold and the succeeding guide surfaces of the thickness-reducing stand, have an inwardly concave curved central part extended laterally by means of two convex parts connected tangentially, on one side, to the concave central part and, on the other side, to a plane end part parallel to the casting axis and intersecting perpendicularly the narrow walls of the mold and the small faces of the product, the said concave central and convex connecting parts being straightened progressively in the thickness-reducing stand, so as to come into alignment with the plane end parts at the exit of the said thickness-reducing stand.

According to another preferred characteristic, the means of retaining the product in the thickness-reducing stand provide continuous frictionless support for the large faces of the product by forming, along the said faces, a film of supporting fluid at a pressure at least equal to the ferrostatic pressure in the product.

In a particularly advantageous embodiment, the thickness-reducing stand is limited by two wide walls, each consisting of a plurality of connected caissons for the injection of fluids under pressure, which are distributed in such a way that their edges are aligned in two directions perpendicular to one another and form, on each wall, a grid retaining the product. Preferably, the retaining grid consists of longitudinal and transverse bars arranged in directions respectively parallel and perpendicular to the casting axis, the longitudinal bars opposite one another forming, two by two, in the central part, a V open at the top, which progressively closes towards the sides, the end longitudinal bars being parallel and at a distance from one another substantially equal to the thickness of the product to be produced, and the transverse bars of one and the same grid forming, at the inlet of the stand, an obtuse angle which opens in the casting direction until it becomes a plane angle at the exit of the stand.

In another embodiment, the means of retaining the product in the thickness-reducing stand consist, on each face, of a plurality of rolls, the distance between which and the diameter of which are determined as a function of the thickness of the solidified skin at this location and of the deformation force exerted on the product. The said rolls are limited by an outer surface of revolution generated by a line which, in the plane passing through the axis of the roll and perpendicular to the casting axis, envelopes the cross-section to be given to the inner space of the stand.

BRIEF DESCRIPTION OF THE DRAWINGS

The invention will be better understood from the following description of several embodiments given as examples and illustrated in the attached drawings.

DESCRIPTION OF THE PREFERRED EMBODIMENTS

Figure 1:
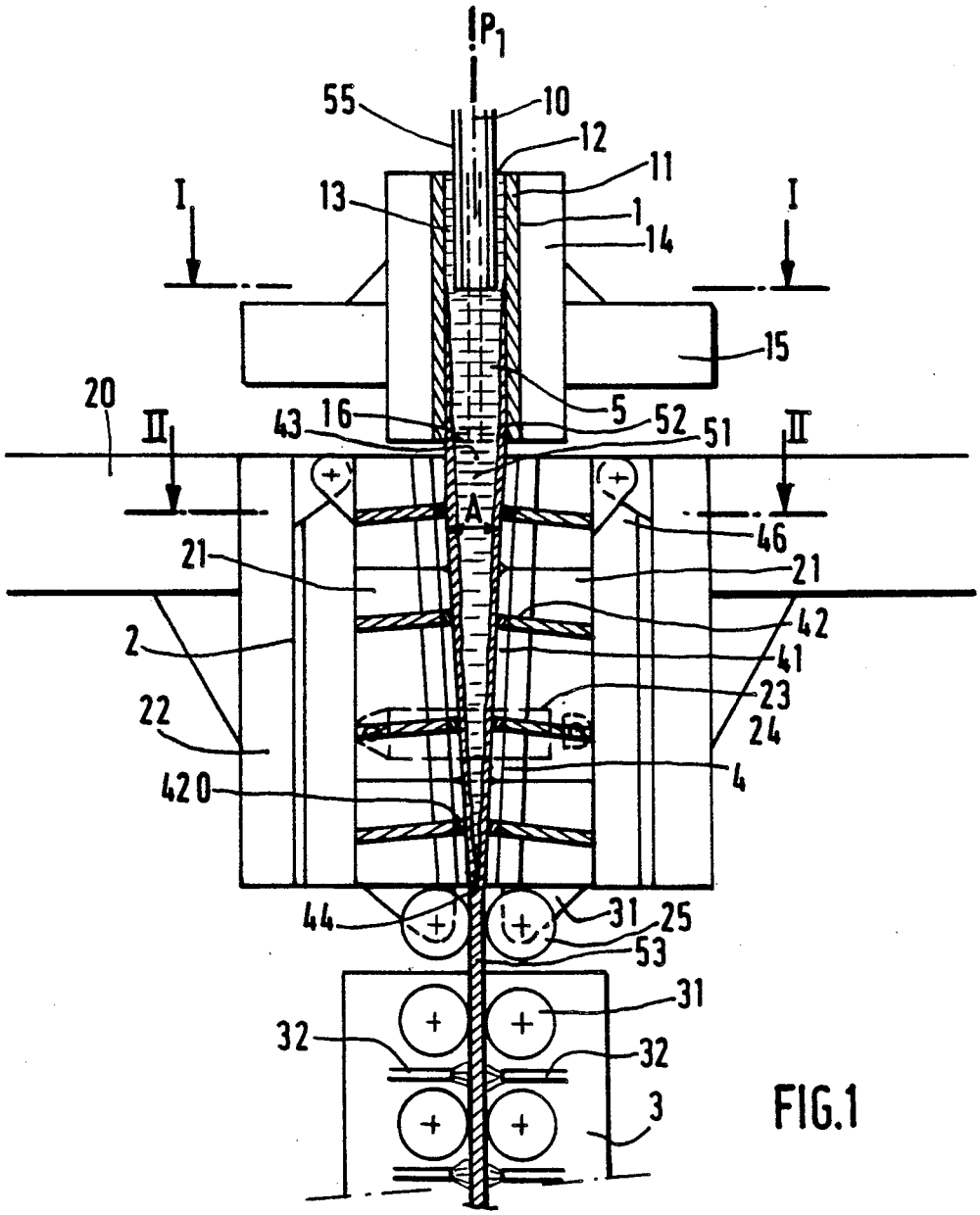
FIG. 1 shows diagrammatically, in a longitudinal section through the mid-plane, the upper part of continuous-casting installation according to the invention.

FIG. 1 illustrated diagrammatically the upper part of a continuous-casting installation, shown in section through the mid-plane P2 perpendicular to the longitudinal walls and passing through the casting axis 10. The installation comprises an open-ended mold 1 opening into a secondary cooling device which, in a conventional way, comprises a first stand 2 arranged directly at the exit off the mold 1 and a cooling and guide jacket 3, in which solidification is completed.

The mold 1 consists, in the usual way, of two wide walls 11 and two narrow or side walls 12 forming respectively the large and small sides of an inner tubular space 13 and which is symmetrical relative to the two mid-planes, namely, a longitudinal plane P1 and a transverse plane P2, and are mounted inside a frame 14, itself fastened to a table 15 which is connected to a casting floor 20 by guide and oscillation means (not shown), which make it possible to drive the mold in oscillating movements along the casting axis 10.

Figure 2:
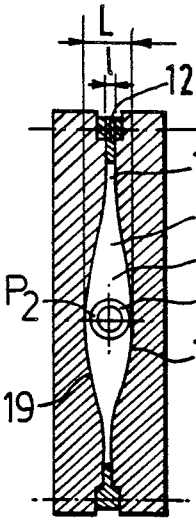
FIG. 2 is a view of a preferred embodiment of the mold in cross-section relative to along line I—I of FIG. 1.
Figure 4:
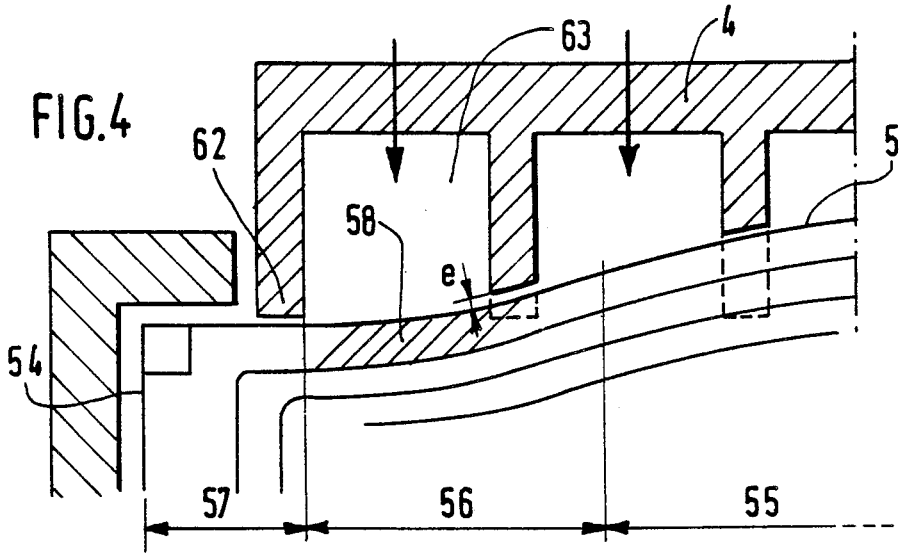
FIG. 4 is a diagrammatic detailed view in quarterly cross-section of the end part of the product and of the thickness-reducing stand.

As can be seen from the cross-section, for example in FIG. 2 and 4, the two wide walls 11 have a cylindrical profile with generatices parallel to the axis, the profile being curved in cross-section so as to delimit a spindle-spaced inner tubular space 13 symmetrical relative to two planes, namely, a longitudinal plane P1 and a transverse plane P2, passing through the axis 10, and having a vaulted central part 17 narrowing progressively, in the direction transverse to the axis, towards two small sides 18 delimitted by the two narrow walls 12 which are inserted in the conventional way between the two wide walls 11 and which have a small width (1) substantially equal to the thickness of the product to be formed. Preferably, as will be seen in more detail later, the longitudinal walls 11 of the mold comprise an inwardly concave central part 17 connected by means of two middle parts 19 to two plane lateral parts 18 parallel to the longitudinal plane of symmetry P1.

The product leaving the mold via the lower orifice 16 therefore has a central part 55 thicker than the edges 57.

At the outlet of the mold, the product 5 passes immediately to the first part 2 of the secondary cooling device, the latter consisting, in the conventional way, of a stand equipped with means of retaining the large faces of the product the constitution of which is designed for the small thickness of the skin solidified at this point.

In the embodiment illustrated in FIG. 1, the means of retaining the two large faces of the product consists of two grid-shaped walls 4 comprising longitudinal bars 41 arranged in planes parallel to the mid-plane and transverse bars 42 at right angles to the axis 10.

The longitudinal bars 41 arranged opposite one another in one and the same vertical plane form, two by two, in a central part, a V open at the top at an angle A which progressively closes towards the sides in such a way that the end longitudinal bars 410 are parallel and at a distance 1 from one another corresponding to the thickness of the strip leaving the mold. Correspondingly, the transverse bars 42, the shape of which is matched to that of the product, form, at the inlet 43 of the retaining stand 2, a curve which opens at an obtuse angle B and the radius of curvature of which increases progressively downwards in the casting direction, the lower bars 420 arranged at the exit of the stand being practically straight.

In this way, the two wide walls 4 delimit an inner space 40 for the passage of the product, having on the sides 48 a constant thickness (1) equal to that of the sides of the mold, in its central part 47, a thickness which decreases progressively in the casting direction between the inlet orifice (43) of the retaining stand 2, of a cross-section identical to that of the exit orifice 16 of the mold, and an exit orifice 44 located in the lower part of the stand 2 and having a rectangular cross-section corresponding to that of the thin product to be formed.

Thus, the product 5 which is formed inside the mold and which, as already indicated, has the shape of the latter, i.e., a thick central part narrowing progressively towards the side in the horizontal direction, enters the upper part of the retaining stand 2, the large faces of which determine a reduction in thickness of the central part in proportion as the product advances in the casting direction. This reduction in thickness is possible because the cast product, at the exit of the mold, consists of a liquid core 51 surrounded by a solidified and consequently deformable skin 52.

However, to obtain this progressive flattening of the product in the thickness-reducing stand, at the same time avoiding defects along the wide walls, in particular cracks which can result in skin splitting, the support given to the wide walls of the product during their advance and straightening must not exert significant stresses on the skin during solidification, but must only subject the latter to uniformly distributed stresses having, at each point, a value compatible with its thickness at such point, and this thickness must both give the necessary strength and at the same time preserve sufficient flexibility to allow the deformation without a deterioration in quality.

Figure 6:
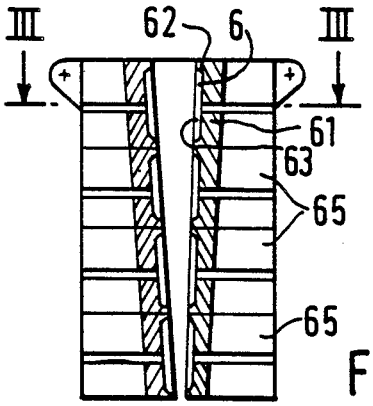
FIG. 6 is a view in longitudinal axial section of a second embodiment of the thickness-reducing stand.

According to the essential characteristic of the invention, it is necessary first of all that the grid retaining the large faces of the product in the thickness-reducing stand should form a bearing surface which is practically continuous and, as far as possible, frictionless. For this purpose, it is expedient if the surfaces retaining the two longitudinal faces of the product in the thickness-reducing stand each consists of a plurality of connected caissons which can be delimited by the longitudinal bars 41 and transverse bears 42 or, alternatively, produced in the way illustrated in FIGS. 6 and 7. Each caisson is closed towards the outside by a bottom 61 and on the sides by edges 62 which, on the same side as the product, limit a wide-aperture orifice 63, into which opens a duct 64 connected to a circuit (not shown) supplying fluid under pressure. The pressure of the fluid is determined as a function of the location of the caisson, i.e., of the level of liquid steel at this point and the shape and thickness of the solidified wall, so as to balance the ferrostatic pressure at this level, with a leakage flow along the edges 62 which, allowing provision of a gap of width (e) between the product and the grid for avoiding contacts (FIG. 4).

The caissons are arranged in successive tiers 65 (FIG. 6), the height of which is determined, on the one hand, so as to avoid an excessively large number of tiers, and, on the other hand, so that the ferrostatic pressure over the height of the caisson is relatively constant.

Figure 7:
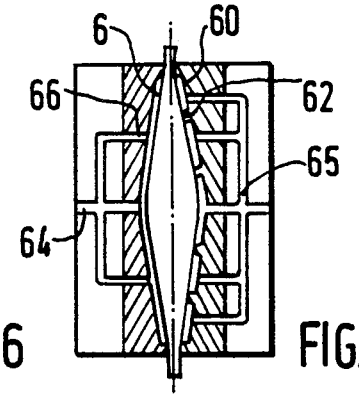
FIG. 7 is across-sectional view along the line III—III of FIG. 6, indicating two alternative embodiments on either side of the major axis.

As shown in the left-hand part of FIG. 7, each tiers 65 can comprise a single caisson which extends over the entire width of the product and which is preferably supplied by means of several fluid injection nozzles 66 connected to a single supply duct 64. However, it is also possible, as shown in the right-hand part of FIG. 7, to distribute in one and the same tier, over the entire width of the product, a certain number of caissons 60 which are connected separately to a single duct 65 supplying fluid under pressure.

Figure 3:
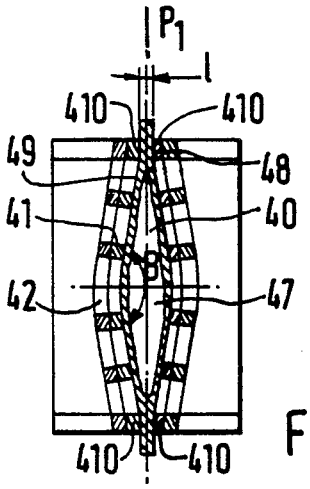
FIG. 3 is a view of the thickness-reducing stand illustrated in FIG. 1, in cross-section along line II—II.

The edges 62 of the caissons are preferably aligned in transverse and longitudinal directions, forming a grip supporting the product, and consequently it is also possible, as in the embodiment of FIG. 3, to limit the caissons by means of longitudinal bars 41 and transverse bars 42.

According to another characteristic of the invention, the profile of the surfaces retaining the large faces of the product is determined as a function of the casting speed and of the cooling conditions, in order to ensure progressive straightening of the said large faces progressively with their thickening and consequently their hardening.

FIG. 4 shows the extreme part of the product 5 and of the wide wall 4 of the thickness-reducing stand. It is advantageous to give the mold 1 an inner cross-section in the form of a spindle, such that, at the exit of the mold, each longitudinal face of the product comprises an outwardly convex central part 55 extended by means of two concave parts 56 connecting tangentially, on one side, to the central part 55 and, on the other side, to a plane end part 57 parallel to the longitudinal plane of symmetry P1 and intersecting the small face 54 of the product perpendicularly and preferably at a sharp angle. Thus, in the upper part of the straightening stand 2, the faces 4 supporting the product 5 will comprise a central part 47 concave towards the axis 10, which is connected by means of convex middle part 49 to lateral parts 48 parallel to the longitudinal plane of symmetry P1.

So, from the outset of casting a product having right-angled edges is produced within the mold itself, and in this way the straightening forces exerted on the large faces of the product are transferred to a certain distance from the small face 54. The direct production of a product with plane edges is useful per se, because it makes it possible to reduce the metal losses but, within the scope of the invention, this particular form also makes it possible to prevent, during flattening, an angular deformation of the lateral end which would be particularly difficult and could be detrimental in this zone.

On the other hand, because the right-angle shape of desired thickness is obtained directly on the sides of the product, a bearing point is provided, and starting from this the deformation process can be carried out progressively by advancing towards the center in proportion as the product advances in the straightening stand, in order to obtain, at the exit of the latter, or a little downstream thereof, a completely solidified product having the desired thin rectangular cross-section.

Figure 5:
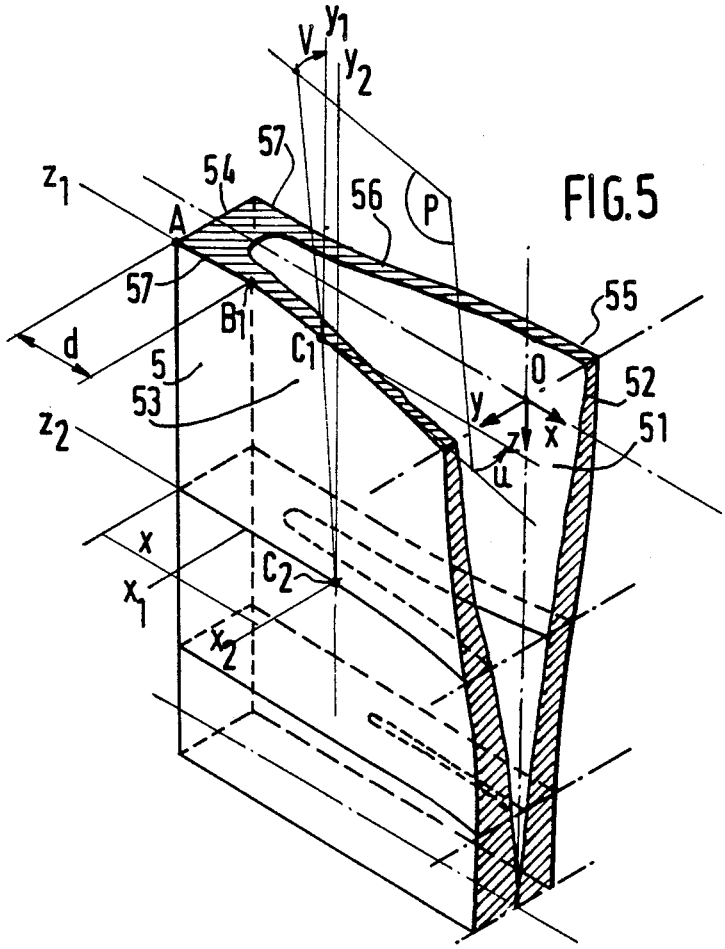
FIG. 5 is a partial perspective view of the product in the thickness-reducing stand with respectively longitudinal and transverse section.

FIGS. 4 and 5 illustrate the straightening process diagrammatically. FIG. 5 shows in perspective the development, inside the thickness-reducing stand (not shown), of the product 5 which comprises a core of liquid metal 51 surrounded by a solidified skin 52, the thickness of which increases in the direction of advance of the product, i.e., in the direction oz, the figure relating to a trihedron Oxyz.

If the development of a large face 53 of the product is considered, the plane end part 57, which extends from the corner A to the point B1, must have a width (d) such that the force straightening the face 53 does not exert any effect on the edge A of the solidified product. According to the essential characteristic of the invention, a thrust distributed continuously over the two curved parts 55 and 56 is exerted, in such a way that the width (d) of the plane part 57 increases continuously in proportion to the advance of the product and to the thickening of the solidified skin 52. Thus, considering a transverse section of the product going through level Z1 from the point A, to level z2, the plane part 57 extends at this level substantially up to the zone c2 which, at the level z1, was located at c1. The plane P tangent to the big face 53 at the point c1 forms an angle U with the axis Ox and an angle V with the axis Oz, and these two angles close progressively from the point c1 to the point c2 during the advance of the product and the straightening of the face 53. The profile of the wide walls 4 of the straightening stand is determined in such a way that the speed dy/dt of transverse displacement of the point c1 and the rotational speeds dU/dt and dV/dt of the tangent plane P in the horizontal direction and the vertical direction respectively are compatible with the cast speed dz/dt of the product and sufficiently low to ensure that the elongations resulting therefrom between the points c1 and c2 do not cause any defect in the solidified skin, taking into account the thickness of the latter and the quality of the metal. In fact, the present knowledge of a technician specialized in continuous casting, which is based on several years of operating casting machines, makes it possible to define with a certain amount of accuracy the resistance to deformation of the solidified skin 52. Bearing in mind the small thickness of the product, this skin preserves sufficient flexibility until complete solidification to allow the progressive straightening which is carried out by means of a uniformly distributed thrust, with the solidified wall pivoting about the zone 58 of connection to the plane part 57 which forms a bearing point for the straightening force, since solidification takes place more rapidly on the lateral edges of the liquid core 51.

The force to be generated in order to deform the shell 52 during solidification comprises two components:

(a) the force necessary to overcome the ferrostatic pressure level opposite the element of volume to be displaced, this force depending on the height of metal at this point; and (b) the force necessary to deform the metal surfaces linking this element of volume to its environment.

The means described above, allowing a fluid film to flow between the cast product and the wall 4 of the stand, make it possible, by virtually eliminating friction, to reduce these forces as much as possible and to prevent deterioration of the surface of the product and of the geometry of the cavity of the reducing stand 4.

It will be noted that it is preferable if the fluid used is not a cooling medium, or at least is a cooling medium to as small an extent as possible, and this makes it appropriate preferably to choose air or a neutral gas instead of water.

Moreover, to avoid generating additional stress in the solidified shell 52, it is preferable for the perimeter of the product in cross-section to be preserved during its descent and flattening in the retaining stand 2. Consequently, as indicated in FIG. 3, the latter will only have wide walls 4 so as to allow the product to widen slightly at the sides. Due to the small width of the product on its sides, there is no disadvantage inherent in the absence of walls retaining the small faces 54, since the solidified skin is sufficiently thick at the exit of the mold.

Because the profile of the supporting faces 4 is determined in such a way that the liquid core 51 continues to be present practically up to the exit orifice 44 of the straightening stand, there is no danger that the product will be jammed at this point as a result of a wedging effect.

The product is then completely solidified, and the lower part 3 of the secondary cooling device, located underneath the straightening stand 2, may consist, in an entirely conventional way, of a series of rolls 31. Moreover, all the conventional arrangements can be used in this part, and it should be noted that the small thickness of the formed product 53 makes it possible to direct it into a horizontal position more quickly than in installations for the casting of relatively thick slabs.

The second part 3 of the secondary cooling device can therefore be shortened or in some cases, omitted, and even if the first stand 2 has to be lengthened, the total height of the installation should, in the end, be reduced.

In general terms, as indicated in FIGS. 2 and 4, the width (L) of the central part of the inner space 13 is determined so as to make it possible to introduce into the mold the casting tube 55 which extends the outlet spout of the intermediate vessel. In this way, it is possible to carry out casting in an entirely conventional manner, in particular with regulation of the flow of liquid steel and of the level of the latter inside the mold.

According to another improvement illustrated in FIG. 1, the wide walls 4 of the straightening stand 2 are each mounted on a supporting frame 21 equipped, in its upper part, with suspension lugs 46 articulated about horizontal axles on a fixed structure 22 or directly on the casting axles on a fixed structure 22 or directly on the casting floor 20. Furthermore, two identical jacks 23 arranged on either side of the stand and supplied and/or controlled simultaneously are articulated, at their two ends, respectively on the two frames 21 supporting the walls 4, Thus, by supplying the double-acting jacks 23 simultaneously in either direction, it is possible to control the opening or closing of the supporting walls 4. It is thus possible to open the straightening stand 2 quickly, for example to release the product in the event of a breakout or jamming for any reason.

The two frames 21 supporting the walls 4 can be articulated on one another or, alternatively, as shown in the drawings be equipped, in their lower part, with rollers 25 which bear directly on the strip 53 at the exit of the straightening stand 2.

Figure 8:
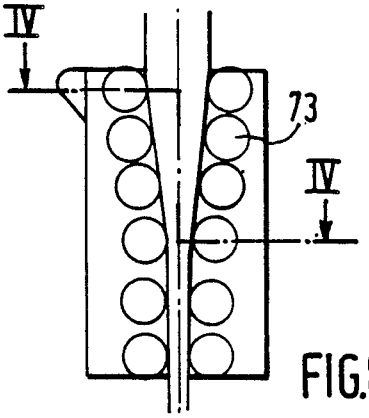
FIG. 8 is a view in longitudinal section of the thickness-reducing stand in an embodiment with rolls.
Figure 9:
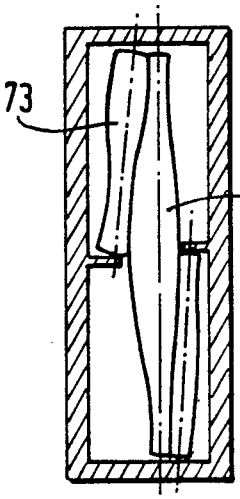
FIG. 9 is a cross-sectional view at two levels along line IV—IV of FIG. 8.

Supporting and deformation elements forming the wide wall 4 must provide a practically continuous support for the product over the entire periphery of its large faces and, as described hereabove, it is better realizing wide walls 4 in shape of grids. However, in some cases, particularly if the properties of the metal give the solidified shell sufficient strength, it would also be possible as shown in FIGS. 8 and 9, to support the large faces and straighten them by means of tools 7 having horizontal axes or, at all events, at right angles to the casting axis 10. The center-to-center distances and the diameters of the rolls are determined as a function of the thickness of the solidified skin and of the height of liquid metal at the corresponding level, to ensure that the wall is retained without the risk of the tearing.

As seen in FIG. 9, the profile of each roll must be determined so that it corresponds at each level to the shape of the product, and consequently, since the latter preferably has a spindle-shaped form, the outer surface of the roll will be formed by a surface of revolution generated by a line which, in the plane passing through the axis of the roll perpendicular to the casting axis 10, envelops the cross-section to be given to the product, so that the rolls as a whole define a retaining and straightening wall of the desired form. Consequently, as illustrated in FIG. 9, the profile of the rolls will depend on their level inside the straightening stand 2, and, because of the width of the product, it may be necessary to arrange an intermediate support in the mid-plane of the product, so that each roll only extends over half the width of the product. It would be possible to use in the thickness-reducing stand other means of retaining the big faces of the product, making it possible to ensure progressive flattening of the product with continuous supporting of its big faces on their all width.

We claim:

1. A process for the continuous casting of thin metal products, comprising the steps of·

(a) pouring molten metal into an openended mold (1) having two wide walls (11) and two narrow walls (12) which are cooled, to form a flat product (5) which consists of a liquid core (51) surrounded by a solidified skin (52);

(b) discharging said flat product through exit orifices (16) of the mold (1) and subsequently passing said product into a secondary cooling device (2, 3) equipped with means (4) for cooling and retaining at least the large faces of the product until complete solidification;

(c) providing the wide walls (11) of the mold in a curved shape so that the cast product has a widened central part (55) narrowing in the form of a spindle to edges having a thickness equal to that of the thin product to be cast; flattening the central part (55) of the product (5) progressively to a thickness equal to that of the edges in a reducing stand (2) located immediately downstream of the exit orifice of the mold (1) and comprising two surfaces for respectively guiding and straightening the two large faces of the product, the profile of which is determined as a function of the casting speed, so as to exert a pressure uniformly distributed over the entire surface thereby causing and controlling, on each of the large faces, the symmetrical movements of two straightening zones from the edge towards the axis at a speed the respectively axial and radial components of which are substantially constant and synchronized with the casting speed, in order to carry out continuous straightening of the wide walls of the product, up to complete solidification.

2. A process for the casting of thin products as claimed in claim 1, comprising giving the mold an inner profile such that the large faces of the product (5) terminate at the edges in plane end parts (57) parallel to the longitudinal plane of symmetry $P_1$, said plane end parts intersecting the large faces (54) of the product perpendicularly, and, in the thickness-reducing stand, straightening the central part (55), with progressive widening of the plane end parts (57), the latter being maintained perpendicular to the small faces (54).

3. Casting process as claimed in claim 1, comprising determining the profile of the supporting faces of the large faces of the product as a function of the casting speed and the cooling conditions, so that each straightening zone moves towards the axis at a substantially constant radial speed and coordinated with the casting speed and with the thickening speed of the solidified skin, whereby the complete solidification and the straightening of the big faces of the product(2) are realized substantially at the same moment at the exit of the thickness-reducing stand (2).

4. Apparatus for the continuous casting of thin metal products comprising, along a casting axis:

(a) an open-ended mold (1) having two wide walls (11) and two narrow walls (12) delimiting an inner tubular space (13) symmetrical relative to a longitudinal plane of symmetry ($P_1$) and to a transverse plane ($P_2$) and having a lower exit orifice (16), said wide walls (11) comprising a curved central part (17) of inwardly concave form, extended laterally by means of two convex parts (19) connecting tangentially, on one side, to said concave central part (17) and, on the other side, to a plane end part (18) parallel to said longitudinal plane of symmetry ($P_1$), said narrow walls (12) being inserted between said plane end parts (18) of said wide walls (11) and having a width (1) substantially equal to the thickness of a thin product to be cast; and (b) a secondary cooling device comprising a thickness-reducing stand (2) located immediately beneath said lower exit orifice (16) and equipped with retaining means (4) defining two substantially continuous guide surfaces for large faces of said product (5), delimiting an inner space (40) for passage of said product, having on its sides (48) a constant thickness (1) equal to that of sides (12) of said mold and, in its central part (47) a thickness (L) decreasing progressively in the casting direction between an inlet orifice (43) of a cross-section identical to that of said exit orifice (16) of said mold (1) and an exit orifice (44) of rectangular cross-section corresponding to that of the thin product (53) to be formed; p1 (c) said guide surfaces (4) comprising a curved central part of inwardly concave form, extended laterally by means of two convex parts (49) connecting tangentially, on a first side thereof, to said concave central part (47) and, on a second side thereof, to a plane end part (48) parallel to said longitudinal plane of symmetry ($P_1$) and intersecting perpendicularly small faces (54) of said product (5), respectively, said concave central parts (47) and said convex connecting parts (49) being straightened progressively in said thickness-reducing stand (2) so as to be aligned with the plane end parts (48) at the outlet of said reducing stand (2).

5. Apparatus for the casting of thin products as claimed in claim 1, wherein said thickness-reducing stand (2) comprises only two guide-surfaces (4) for large faces of said product (5) and is devoid of walls for retaining said small faces (54).

6. A machine for the casting of thin products as claimed in claim 4, wherein, in the thickness-reducing stand (2), the product (5) is left free to widen towards the sides as a function of the flattening of its central part, the perimeter of the product in cross-section relative to the axis remaining preserved.

7. A continuous-casting machine as claimed in claim 4, wherein the transverse width (d) of the plane end parts (18, 48) of the wide walls of the mold (1) and of the guide surfaces at the inlet of the thickness-reducing stand (2) are determined as a function of the ratio between the thicknesses (L and 1) of the product in the central part of the mold and on the sides, the cooling conditions, the casting speed and speed of reduction in thickness of the central part, so that the stresses attributable to the straightening of the big faces of the product are at each point compatible with the strength of the solidified skin (52) and generating no defects.

8. A continuous-casting machine as claimed in claim 4, wherein the means (4) of retaining the product in the thickness-reducing stand (2) ensure an uniform and continuous frictionless support of the longitudinal faces of the product by forming, along the said faces, a supporting fluid film at a pressure at least equal to the ferro-static pressure in the product.

9. A continuous-casting machine as claimed in claim 8, wherein the supporting fluid is a poor conductor of heat.

10. A machine for the casting of thin products as claimed in claim 8, wherein the thickness-reducing stand (2) is limited by two longitudinal walls, each consisting of a plurality of caissons (6) which open onto the inner space (40) and into which the supporting fluid is injected, with a leakage flow for keeping the product separated from the edges (62) of the caisson (6).

11. A machine for the casting of thin products as claimed in claim 10, wherein the fluid injection ciassons (6) are distributed in such a way that their edges (62) are aligned in two perpendicular directions and on each wall form a grid retaining the products.

12. A machine for the casting of thin products as claimed in claim 4, wherein the thickness-reducing stand (2) is delimited by two grid-shaped wide walls (4) retaining the product, comprising longitudinal bars (41) and transverse bars (42) arranged in planes respectively parallel and perpendicular to the casting axis (10), the longitudinal bars (41) opposite one another forming, two by two, in the central part (47), a V open at the top, which closes progressively towards the sides (48), the end longitudinal bars (410) being parallel and at a distance (1) from one another substantially equal to the thickness of the product to be formed, and the transverse bars (42) of one and the same grid forming, at the inlet (43) of the stand, an obtuse angle (B) which opens in the casting direction until it becomes a plane angle at the exit of the stand (2).

13. A casting machine as claimed in any one of claims 7, 4 and 5, wherein the means of retaining the product in the thickness-reducing stand consists, for each large face, of at least one series of rolls of small diameter (73), having axes which are parallel and arranged in planes spaced from one another and perpendicular to the casting axis, the said rolls (73) being limited by an outer surface of revolution generated by a line which, in the plane passing through the ais of the roll and perpendicular to the casting axis, envelopes the cross-section to be given to the inner space (40) of the stand.

* * * * *